United States Patent [19]

Snellen, deceased

[11] Patent Number: 5,058,324

[45] Date of Patent: Oct. 22, 1991

[54] GEM STONE FACET FORMING APPARATUS

[76] Inventor: Paul F. Snellen, deceased, late of 1358 Neece Ave., Norton Shores, Mich. 49441, by Phyllis Daugherty executrix

[21] Appl. No.: 469,202

[22] Filed: Jan. 24, 1990

[51] Int. Cl.[5] ..... B24B 19/16; B24B 9/16

[52] U.S. Cl. ..... 51/124 R; 51/229; 51/125.5; 51/216 ND

[58] Field of Search ..... 51/124 R, 125, 125.5, 51/215 CP, 229, 216 ND

[56] References Cited

U.S. PATENT DOCUMENTS

| | | | |
|---|---|---|---|
| 1,461,149 | 7/1923 | Hunt | 51/229 X |
| 3,098,327 | 7/1963 | Malin | 51/229 X |
| 3,811,229 | 5/1974 | Montgomery | 51/216 LP X |
| 3,811,230 | 5/1974 | Beck | 51/229 X |
| 3,902,283 | 9/1975 | Bean | 51/229 X |
| 4,106,240 | 8/1978 | DeBartolo | 51/229 X |

*Primary Examiner*—D. S. Meislin

*Attorney, Agent, or Firm*—Robert K. Wallor

[57] ABSTRACT

A gem stone facet cutting apparatus is provided to include a cutting wheel rotating in a horizontal plane and supported above a base portion containing a variable speed cutting wheel drive system. A work on which facets are to be cut is supported at the facet angle and work orientation from above in a cantilevered manner from an upwardly extending, horizontally positionable, support column coupled to the base portion. A supporting bracket is coupled to the support column in a selectable vertical position. A pantographic structure is cantilevered, at a first end thereof, from the supporting bracket to extend toward the cutting wheel. A second end of the pantographic structure supports a horizonally extending support arm to which a sleeve member is pivotably coupled by a horizontal trunnion axis transverse to the extent of the pantographic structure. A dop holder is journaled within the sleeve to rotate about a longitudinal axis of the sleeve. Appropriate angular calibrations, indexing, and positional and orientational locking means are provided to readily, repeatably place the work at a desired facet angle and orientation.

13 Claims, 3 Drawing Sheets

GEM STONE FACET FORMING APPARATUS

BACKGROUND OF THE INVENTION

1. Field of the Invention

The present invention relates to grinding apparatus, and particularly to an apparatus for grinding and polishing facets in precious stones and the like so as to repeatably maintain constant facet angles during each grinding or polishing operation.

2. Description of the Prior Art

Theretofore it has been well known in the art to have an apparatus providing a substantially horizontally planar grinding or polishing surface having a substantially circular area, which surface is driven to rotate in a substantially horizontal plane about the centroid of the area. A gem stone or other item to be ground or polished so as to have a finished facet is held in a fixed orientation against the grinding or polishing surface. Several means have been devised to accomplish the latter feature, as are briefly described in the patents discussed below.

U.S. Pat. No. 1,461,149, issued on July 10, 1923 to A. T. Hunt, discloses an Apparatus for Cutting Diamonds. Without distinguishing between those features described in this patent as "old" and those features alleged to be "new", the apparatus can be considered as a combination of two subsystems, one driving the cutting wheel and the other positioning the diamond to be cut. The wheel driving system has a cutting wheel, having a substantially planar horizontal cutting surface, mounted on a vertical axis, about which axis the wheel is rotated by an electric motor. The wheel, its axis, and the electric motor are, in turn, rotated in a planetary manner about a vertical axis proximate to, but within, the periphery of the grinding wheel. The diamond to be cut is held against the cutting surface of the cutting wheel at substantially the centroid of the planetary rotation by a pivotable supporting structure which allows the diamond to be lifted from contact with the cutting surface, examined, and returned to the cutting surface for further cutting on the same facet. The support means also provides for adjustment in the angular position at which the stone is held and also in the orientation of the stone about an axis through the support structure.

The latter feature can be better understood through a brief general discussion of the nature of cutting facets on gem stones. In substantially all of the several forms of apparatus for cutting such facets that have been found in the prior art, the stone to be cut is rigidly held on or within a chuck or a "dop". This chuck or dop is then supported over the cutting wheel at an angle appropriate to the desired facet to be cut. Changing the angle of support provides for the cutting of a differing facet angle. Rotation of the chuck or dop about an axis of support thereof through an appropriate angle of rotation enables a plurality of facets having the same facet angle to be cut on the surface of the gem stone. In the Hunt apparatus, a further adjustment must be made in the horizontal positioning of the support structure as the facet angle is changed so that portion of the surface of the stone to be cut is brought into substantial vertical registration with the centroid of the planetary rotation of the cutting wheel system.

U.S. Pat. No. 3,811,230, issued on May 21, 1974 to A. Beck for a Facet Grinding Apparatus, discloses the use of a parallelogram lever arrangement to establish and maintain a particular facet angle at which the work is held against the cutting wheel to enable cutting a plurality of facets of equal facet angle around the periphery of the gem stone being cut. Several indexing means are provided to indicate the facet angle, the amount of gem stone material removed during cutting, and the rotational position of the facet about the axis of support of the dop holding the gem stone.

One approach to cyclical control of gem grinding is disclosed by the Gem Grinder With Approach Control Means of P. D. Bean in U.S. Pat. No. 3,902,283. issued Sept. 2, 1975. In this system, a dop holder is supported by a mechanized, variably positionable holder cantilevered from an arcuate structural arm extending upwardly to a distal end over a cutting wheel surface. The arcuate arm is coupled to a vertical mechanism which provides for accurate adjustment and control of the vertical extent of the arcuate arm. The vertical support mechanism is also provided with horizontal motion drive and control to appropriately position the arcuate arm over the surface of the cutting wheel. Once a gem stone has been appropriately mounted on a dop and placed in the dop holder riding on the arcuate arm, the controls are set for a desired facet angle and rotational orientation of the facet. Activation of the system then causes the vertical support to move upwardly, and the dop holder mechanism to ride up the arcuate arm so that the appropriate facet angle is attained between the axis of the dop holder and the surface of the cutting wheel. The vertical support is then caused to translate horizontally to bring the stone over the cutting wheel, at which time the vertical support is again lowered to bring the stone into contact with the cutting surface. A pressure sensitive driving mechanism is contained within the dop holder to axially drive the stone against the cutting wheel surface, maintaining a appropriate cutting pressure throughout. Strain guages and limit switches are employed to appropriately limit the cutting. When a first facet has been cut at a given angle, the dop holder is returned to its initial axial position, the vertical support is upwardly extended, and the dop holder is caused to rotate about its axis to attain the orientation of the subsequent facet, whereat the vertical arm is again lowered and the dop holder is axially extended through completion of the cutting of this facet. Cutting of facets at a second and subsequent facet angles is accomplished and controlled in a like manner except that for each change in facet angle, the vertical and horizontal positioning of the vertical support of the arcuate arm is appropriately adjusted.

Other gem stone cutting devices are known, but the aforementioned examples represent the extent of the prior art most closely approaching the present invention of which the applicant is presently aware. Such other systems and devices range from a simple cutting wheel against which a gem stone is substantially manually held, to apparatus wherein a dop holding the stone being cut is manually repositioned and clamped for each facet to be cut. None of such other known apparatus provides for the accuracy and repeatability of the specific examples described hereinabove.

SUMMARY OF THE INVENTION

Accordingly, it is an object of the present invention to provide an apparatus for cutting facets on gem stones, wherein the facets so cut are repeatably of uniform facet angle.

It is another object of the present invention to provide an apparatus for cutting facets on gem stones whereby an integer plurality of facets at a desired facet angle may be uniformly cut around an axis of the stone.

It is a further object of the present invention to provide an apparatus for cutting facets on a gem stone whereby the facets of equal facet angle may be rotationally separated by minimal angles of rotation about the axis of the stone so as to substantially form a surface of revolution about said axis of rotation of the stone.

It is an additional object of the present invention to provide an apparatus for cutting facets on a gem stone wherein the pressure exerted between the surface of the cutting wheel and the surface of the facet being cut is maintained to be substantially uniform across the surface area of the facet being cut throughout the process of cutting said facet.

Another object of the present invention is to provide an apparatus for cutting facets on gem stones wherein all desired facets to be cut on a particular gem stone may be cut with the stone remaining mounted to or held by its dop in a single position and orientation relative to the dop throughout the cutting of all such facets.

An additional object of the present invention is to provide an apparatus for cutting facets on gem stones whereby a plurality of gem stones may be so cut as to have substantially identical resulting shapes.

A further object of the present invention is to provide an apparatus for cutting facets on gem stones wherein adjustments between the cutting of different facets are readily accomplished.

Yet another object of the present invention is to provide an apparatus for cutting facets on gem stones, which apparatus is readily adaptable to automated or robotic operation.

Yet a further object of the present invention is to provide an apparatus for cutting facets on gem stones wherein said apparatus is sufficiently substantial in construction to enable heavy-duty, extended use, while retaining sufficient simplicity of design to enable its manufacture at a reasonable cost.

Yet an additional object of the present invention is to provide an apparatus which, while intended primarily for cutting facets on gem stones, may be utilized for grinding or cutting or polishing substantially planar surfaces on any appropriate work material.

These, and other objects, features and advantages of the present invention which may become evident through consideration of the hereinafter disclosure of the present invention, are provided by an apparatus comprising a base portion, a turntable mechanism, and a dop supporting structure.

The base portion provides a housing for typical mechanism driving the turntable, including control means for regulating the rotational speed of the turntable. The base portion also provides sufficient mass so that the apparatus is stable during operation, while the base supports the turntable mechanism and the dop supporting structure. The base portion may also, in various embodiments, incorporate structure, means and mechanisms for providing the turntable with cutting liquid slurry, lubricants, and the like, as well as housing controls and mechanisms for robotic operation of the apparatus.

The turntable portion is disposed to be supported proximate to one end of the base portion so as to extend upwardly therefrom. The turntable portion typically includes a substantially horizontal circular plate supported on the upper end of a shaft journaled to the base portion. The horizontal plate carries the cutting material used in operation of the apparatus for its intended purposes. The turntable portion may also include an upwardly open housing surrounding the rotating plate to shield against splatter of cutting residue and to serve as a reservoir for catching liquid cutting slurry for recirculation. The housing may extend downwardly to interface with the base portion to enclose the shaft driving the turntable.

The dop supporting structure comprises a dop holder, a dop holder support arm, a pantographic support mechanism, a supporting bracket, and a support column. The dop holder is configured generally as a circular cylindrical structure having an axial chamber for receiving a dop bearing a work to be cut with facets, the dop being insertable into a first end of the dop holder. Means are provided in the dop holder to removably retain the dop in the holder such that the work is held in a fixed position and orientation of rotation about the axis of the dop holder, relative to the first end of the dop holder. The dop holder is journaled within a sleeve coaxially disposed thereabout such that the dop holder may rotate about its axis relative to the sleeve. The sleeve is provided with means for locking the rotational position of the dop holder relative to the sleeve, and may also include indexing means to establish a plurality of lockable rotational orientations of the dop holder.

A pair of trunnions are rigidly affixed to sides of the sleeve in diametrically opposed positions such that their mutual extent describes a pivot axis orthogonal to the longitudinal axis of the dop holder. The trunnions are supported by distal ends of a forked extended portion of the dop holder support arm such that the sleeve and dop holder may pivot thereabout in a substantially vertical plane, causing the work held by the dop the be movable in an arc within the vertical plane. The dop holder support arm also supports an arcuate arm disposed to be proximate to an arc within the vertical plane through which the second end of the dop holder moves as the sleeve is thus pivoted about the trunnions. Means are provided to releasably lock the second end of the dop holder to the arcuate arm in any desired pivoted orientation of the dop holder relative to the dop holder support arm. Indexing means may be provided to accurately establish the angle of the longitudinal axis of the dop holder relative to a vertical axis passing through the work so as to be perpendicular to the cutting surface of the turntable.

The dop holder support arm is rigidly horizontally cantilevered from a substantially vertically disposed spacer block forming a first element of the pantographic support mechanism. A pair of upper beam members are pivotably coupled, proximate to a respective first end of each, to opposed sides of the spacer block proximate to its uppermost end. The pivot axis so established is oriented to be parallel with the axis described by the trunnions. A pair of lower beam members are similarly pivotably coupled, near their respective first ends, to opposed sides of the spacer block, proximate to its lowermost end, such that their mutual pivot axis is also parallel with the trunnion axis as well as with the pivot axis of the upper beam members. The upper beam members and the lower beam members are configured to have substantially equal lengths and extend from their respective first end to their respective obverse ends in mutually parallel directions. Proximate to the obverse end of each of the upper and lower beam members, provision is made for pivotably coupling each said beam member to the appropriate side of the supporting bracket, the upper beam members being coupled to a substantially horizontal axis through an uppermost end of the supporting bracket and the lower beam members being coupled to a parallel axis through a lower portion of the supporting bracket. The latter two pivot axes are constrained to be parallelly coplanar in a vertical plane. They are further constrained to be parallel with the pivot axes at the first ends of the beam members and with the trunnion axis. When so assembled, the supporting bracket and the spacer block serve as parallelly vertical ends of a parallelopiped wherein the upper and the lower beam members delineate the corners of the respective sides of such a solid figure through all allowable pivoting of the pantographic mechanism.

The supporting bracket is, in a first embodiment, configured to be vertically translatable on a vertical shaft forming a part of the support column. The vertical position of the supporting bracket on the shaft is maintainable at a desired elevation by the inclusion of means for releasably locking the supporting bracket to the shaft. The supporting bracket is also configured to include a shelf portion extending substantially horizontally in a direction toward the vertical plane defined by the upper and lower beam member pivot axes through the spacer block and generally toward the work. This shelf extension projects a distance sufficient to provide a rest for the spacer block as the pantographic mechanism is pivoted to bring the dop holder downwardly toward the turntable.

The support column includes the vertical shaft portion extending upwardly between the beam members of the pantographic mechanism from a mounting bracket which is rigidly coupled to a slide engaging a guideway formed in the upper surface of the base portion. The guideway is oriented to extend generally toward and away from the center of rotation of the turntable and is present to enable separation of the axis of the vertical shaft from the axis of rotation of the turntable to be varied to accommodate placing the work into contact with an appropriate region of the turntable as the facet angle of the work is changed.

Since the dop holder, the sleeve, the support arm, and the pantographic mechanism are all, in effect, cantilevered from the supporting bracket, it is customary to facilitate the upward and downward pivoting of the pantographic mechanism by the inclusion of a counterweight coupled to the pivoting portion and extending outwardly therefrom in a direction generally opposite that of the dop holder. In the present apparatus, the positioning of the counterweight is adjustable so that the pressure exerted by the work in contact with the turntable can be controlled to approach optimal cutting pressure. Additionally, the spacer block may include a feeler guage which engages an adjustable stop on the shelf portion of the supporting bracket to provide the user with a means for indicating when cutting of a particular facet has been completed.

In an alternate embodiment, the support column is formed to be a threaded shaft Journaled to the base slide bracket such that the shaft may rotate about its vertical axis, and the supporting bracket is formed to have internal matching threads engaging the threads of the shaft such that rotation of the shaft causes the supporting bracket to translate vertically in a direction appropriate to the pitch of the threads on the shaft and its direction of rotation. A second guide shaft is rigidly coupled to the base slide element to extend vertically upward through a slidable vertical hole through the supporting bracket, thus precluding rotation of the cantilevered dop supporting elements and the supporting bracket through a horizontal arc as the threaded shaft is rotated.

Automated or robotic operation of the present apparatus may be readily accomplished by the inclusion of means for controllably rotating and positioning the dop holder about its longitudinal axis within the sleeve, means for controllably pivoting and positioning the sleeve and dop holder about the trunnions, means for controllably rotating a threaded shaft of the support column to position the supporting bracket at the appropriate elevation, means for controllably positioning the counterweight to alternately provide the desired cutting pressure and to pivot the pantographic mechanism so as to elevate the work from the turntable, means for controllably adjusting a cutting stop, means for controllably translating the support column along its guideway in the base portion so as to attain the proper separation from the turntable, and means for controllably varying the rotational speed of the turntable. Implicit in this expanded embodiment, are a plurality of means for sensing the several angular and translational controllable motions and positions such that signals from such sensors may be utilized by a programmed control system to perform a desired sequence of cutting and repositioning operations, with manual intervention being necessary only to replace and set up a new work at an appropriate index.

The further inclusion of a turntable supporting the support column, the horizontal guideway, and the appropriate positioning and control elements, allowing the entire dop supporting structure to be controllably rotated about a vertical axis, enables automated operation of shifting the cutting of a given facet from a rough cutting turntable to finer and finishing cutting turntables appropriately situated in a horizontal plane surrounding the supporting structure.

BRIEF DESCRIPTION OF THE DRAWING

In the accompanying drawing, wherein like reference numbers and symbols are used throughout to refer to like elements and features.

DETAILED DESCRIPTION OF THE INVENTION

Figure 1:
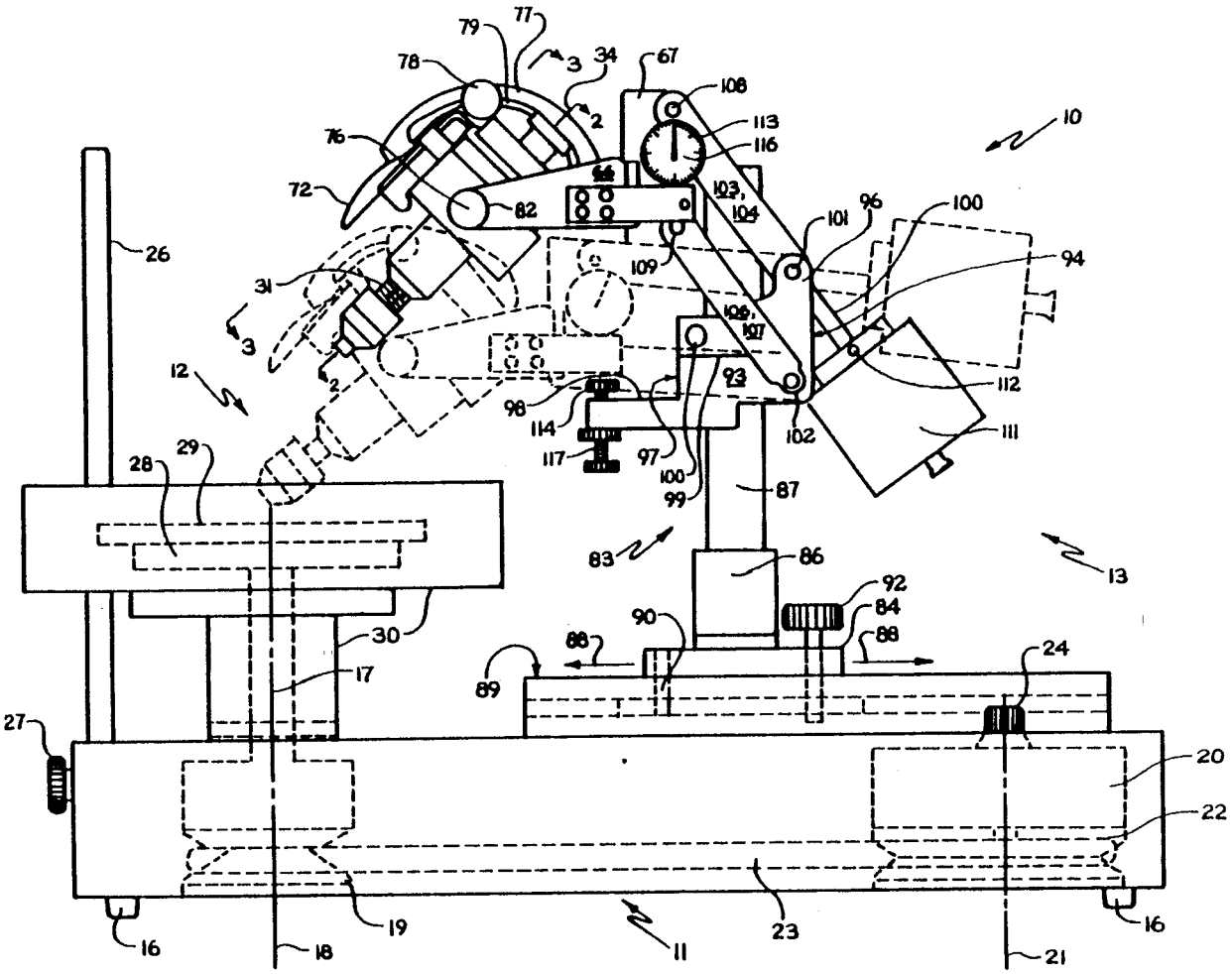
FIG. 1 is a side elevation view of an apparatus in accordance with the present invention.

Referring first to FIG. 1, a gem stone facet forming apparatus in accordance with the present invention is indicated generally at 10. The apparatus 10 can, for ease of description, be segregated into three major subassemblies, to include a base portion 11, a turntable assembly 12, and a work supporting mechanism and structure 13. In keeping with the customary practices and nomenclature of the art of cutting and finishing gem stones prior to their use in creating items of Jewelry and the like, a rough stone, or work as used herein, is first provided with an appropriate surface, to remain substantially hidden in a finished item, which surface is generally used to mount the work on a holder often called a dop (not illustrated). Most forms of a dop are configured as a small, rigid shaft having a first end adapted to accept a work by means of an adhesive or other rigid bonding technique. The shaft of the dop is adapted to be rigidly held, in an appropriate manner, by an apparatus such as the apparatus 10 of the present invention.

Considering initially the base portion 11, it is evident that standard construction and components are generally employed. The base portion 11 provides a support for both the turntable assembly 12 and the work supporting mechanism and structure 13. The base portion 11 is generally configured as a substantially rectangular housing 14 resting on a plurality of legs 16 supporting the base portion 11 on a generally horizontal working surface or table (not illustrated).

The base portion 11 also serves as a housing for other mechanical and electrical elements of the apparatus 10. In particular, a driving mechanism for rotating the cutting surface of the turntable assembly 12 is, in large part, housed within the base portion 11. Immediately below the turntable assembly 12, the base portion 11 internally supports a shaft 17 Journaled to rotate about a vertical axis 18. The lowermost end of the shaft 17 is rigidly coupled to a pulley 19. A variable speed electric drive motor 20 is internally mounted within an obverse end of the base portion 11 such that its rotor revolves about a vertical axis 21. A second pulley 22 is rigidly coupled to the rotor of the electric motor 20 so as to revolve with it. A typical continuous loop V-belt 23 passes around both pulleys 19 and 22 to transmit the rotation of the rotor of the motor 20 to the shaft 17. Means (not illustrated) for supplying electric power to the motor 20 are brought from within the base portion 11 to an external source of such power in a common manner. In the most general embodiment of the apparatus 10, a rheostatic control 24, enabling variation of the rotational speed of the turntable, is disposed to be manually operable at an upper external surface of the base portion 11.

The base portion 11 may also be provided with a removable cutting lubricant support post 26 affixed thereto, typically by use of a thumb screw 27 acting against the post 26 as it passes through a vertical passage in the structure of the base portion 11. The support post 26 may support either a reservoir (not shown) holding a cutting slurry or it may support a nozzled outlet directing a stream of slurry or water onto a cutting surface of the turntable assembly 12. The base portion 11 may also house a recirculating system for recovery of such a cutting slurry and a pump to deliver such a slurry to a nozzle supported by the post 26.

Considering next the turntable assembly 12 of the present apparatus 10, which assembly 12 is also comprised of generally standard elements, the uppermost end of the shaft 17 is rigidly coupled to the centroid of a generally circular plate 28 having a substantially horizontally disposed upper planar surface. A substantially circular slab or bed 29 of cutting material is rigidly coupled to the upper surface of the plate 28. The plate 28 and the attached slab or bed 29 thereby rotate in a substantially horizontal plane as the shaft 17 is driven. The uppermost surface of the slab or bed 29 of cutting material is contacted by the work during facet forming operation of the apparatus 10, as will be explained in greater detail hereinbelow.

The turntable assembly 12 may, for convenience and aesthetic appearance, be surrounded by an upwardly open shroud 30, which may also serve as a basin for capture of the cutting slurry, as well as shielding the user and surroundings from splatter and from contact with the rotating shaft 17, plate 28, and cutting slab 29.

Again, briefly referring to customary gem stone facet cutting procedures, a work is usually cut so that a plurality of polished flat surfaces are formed thereon as a desired family of differing angular surface orientations. For this discussion, it is to be assumed that a direction parallel to the plane of bonding of the work to the dop can be identified as "transverse" and that a direction parallel to the dop shaft can be identified as "longitudinal". As an example, a stone cut in a manner commonly termed a "brilliant cut" has an integer number of longitudinally oriented planar surfaces distributed equally around the periphery of the work. A second plurality of planar surfaces is formed to be equiangularly distributed around the periphery of the work, with each such planar surface being canted equally from the longitudinal direction toward an extension of the axis of the dop shaft extending distally from the work toward the cutting surface. Additional pluralities of planar surfaces, each plurality having a differing degree of cant, are formed on the surface of the work until the last surface is formed as a single, small transverse planar surface. It can be readily understood that positioning of the work, both as to the angular relationship of the axis of the dop shaft to the plane of the cutting surface 29 and as to the rotation of the work about the axis of the dop shaft, is crucial to the attainment of a finished cut gem stone having a high degree of symmetry and uniformity. Thus, the design and construction of the work supporting mechanism and structure 13 must provide the necessary freedoms of motion, positioning capabilities, and repeatability of positioning with a high degree of accuracy.

Figure 2:
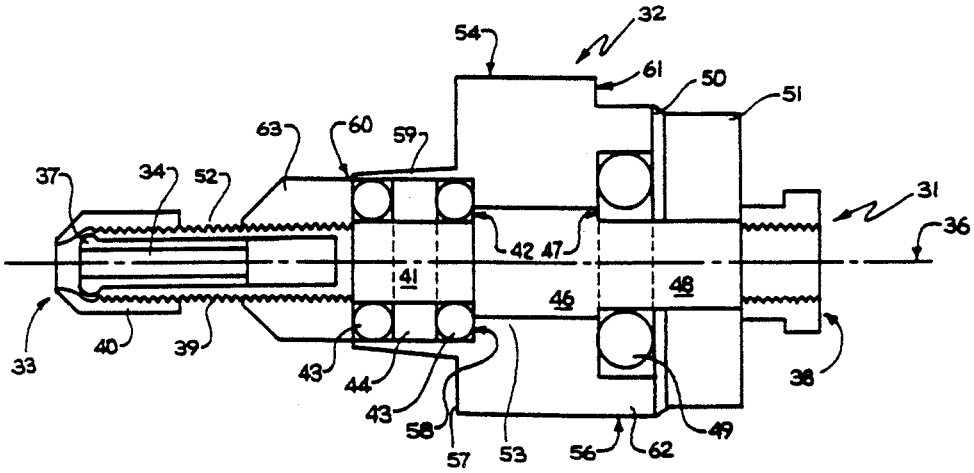
FIG. 2 is a cross-sectional view of a dop holder and sleeve in accordance with the present invention, taken through a plane indicated as 2—2 in FIG. 1.

Referring next to FIG. 2, the manner in which a dop bearing a work is held in a dop holder 31 which is in turn held in a sleeve 32 is depicted in cross-section. The dop holder 31 is generally configured as a right circular cylindrical solid having a plurality of diameters distributed along its length. A first end 33 of the dop holder 31 is provided with an internally formed right circular cylindrical cavity 34 disposed to be concentric with a longitudinal axis 36 of the dop holder 31. Said cavity 34 extends longitudinally into the dop holder 31 for a distance at least sufficient to accept the shalt of a standard dop longitudinally placed therewithin. The diameter of the cavity 34 is established to be such that a standard radially compressible collet 37 for accepting and holding the dop may be removably inserted into said cavity 34. The outer circumferential surface of the dop holder 31, from said first end 33 to an extent toward an obverse end 38 thereof substantially equal to the longitudinal extent of said cavity 34, is provided with external screw threads 39. A collet closing chuck 40 having internal threads matching the threads 39 is screwed onto said first end 33 of the dop holder 31. Continued engagement of the chuck 40 with the threads 39 will, when a dop shaft is present within the cavity 34, cause the end of the collet 37 proximate to said first end 33 of the dop holder 31 to radially contract so as to grasp and retain the shaft of the dop.

A second longitudinal region 41 of the dop holder 31, extending toward said obverse end 38 from the end of the threads 39 to a shoulder 42 serves as a circumferential seat for at least one rotational bearing set 43 seated longitudinally against said shoulder 42. In the illustrated embodiment, the bearing set 43 is shown to include two rotational bearings separated by a spacer 44.

Continuing longitudinally of the extent of said dop holder 31, a third region 46, having the greatest of the diameters formed on the dop holder 31, extends to a second shoulder 47. A fourth region 48 is formed as a circumferential seat for another rotational bearing set 49, said fourth region 48 extending longitudinally from said second shoulder 47 toward said obverse end 38 through an extent sufficient to accomodate seating of the bearing set 49, a retainer 50, and an annular indexing ring 51, which ring 51 is rotational keyed to said dop holder 31 so that both elements rotate about the longitudinal axis of the dop holder 31 in unison.

The remainder cf the longitudinal extent of the dop holder 31, to said obverse end 38 thereof, is formed to have external screw threads 52.

The sleeve 32 is configured generally as a rectangular solid block having a right circular cylindrical hole 53 formed therethrough in a direction defined to be longitudinal. It is to be noted that the hole 53 is formed to be off-center with respect to the illustrated upper side 54 and the illustrated lower side 56. The diameter of the hole 53 is such that the greatest diameter of the dop holder 31, that forming the third region 46 of the dop holder 31, is freely rotatable therein about the longitudinal axis 36 of the dop holder 31. With further reference to the illustration, the transverse surface 57 of the sleeve 32 disposed most proximate to the assembled first end 33 of the dop holder 31, is further configured to have an enlarged circular bore region, concentric with the hole 53, extending inwardly of said sleeve 32 to a first shoulder 58, and to also have an annular flange portion 59 extending longitudinally toward said first end 33 of said dop holder 31. Said annular flange 59 has an inner diameter equal to to that of said enlarged bore portion terminated by said first shoulder 58. The longitudinal extent of this enlarged bore portion from said first shoulder 58 to a distal end 60 of said annular flange 59 is substantially equal to the longitudinal extent of said second region 41 of said dop holder 31. A second transverse surface 61 of said sleeve 32 has a second annular flange 62 integrally formed thereon to extend longitudinally toward said obverse end 38 of said dop holder 31 through a distance sufficient to provide an outer annular seat for said second rotational bearing set 49. It is to be noted that the longitudinal extent of the hole 53 through said sleeve 32, from said first shoulder 58 to said second transverse surface 61 is substantially equal to the longitudinal extent of said third region 46 of said dop holder 31.

Assembly of the dop holder 31 into the sleeve 32 is accomplished by inserting the first end 33 of the dop holder 31 into the hole 53 through the sleeve 32 in a direction progressing from the second transverse surface 61 of the sleeve 32 toward the first transverse surface 57 of the sleeve 32. Said insertion is to continue until the third region 46 of the dop holder 31 is substantially longitudinally coextensive with the minimum diameter extent of the hole 53 through the sleeve 32. Maintaining this relative longitudinal positioning of the dop holder 31 and the sleeve 32, the rotational bearing set 43 is passed over the first end 33 of the dop holder 31 so as to be seated against the shoulder 47 between the second region 41 and the third region 46 of the dop holder 31, concurrently inserting said bearing set 43 into the cavity formed by the annular flange 59. A retaining nut 63, having internal threads matching threads 39 of the first region at the first end 33 of the dop holder 31, is then threaded over said first end 33 of the dop holder 31 and longitudinally advanced toward said obverse end 38 until said retaining nut 63 firmly holds the bearings 43 in place. A set screw (not illustrated) may be employed tranversely through the retaining nut 63 to lock said nut 63 in the desired threaded position. Next, the second rotational bearing set 49 is passed over the obverse end 38 of the dop holder 31 and translated toward said first end 33 until fully seated against said second shoulder 47 of said dop holder 31 and within the second annular flange 62 of the sleeve 32. The retainer 50 and the indexing ring 51 are then translated over the fourth region 48 of the dop holder 31 so as to firmly hold the bearing 49 in place. A second retaining nut 64, having internal threads matching those formed on the obverse end 38 portion of the dop holder 31, is then threaded onto said obverse end 38 sufficiently to preclude longitudinal translation of the retainer 50, the indexing ring 51, or the bearing set 49. The nut 64 is typically held secure by forming its threads in the manner of a standard lock nut. Lastly, the collet 37 is appropriately inserted into the cavity 34 in the first end 33 of the dop holder 31, and the chuck 40 is threadably engaged with the threads 39 of said first end 33 of the dop holder 31.

Figure 3:
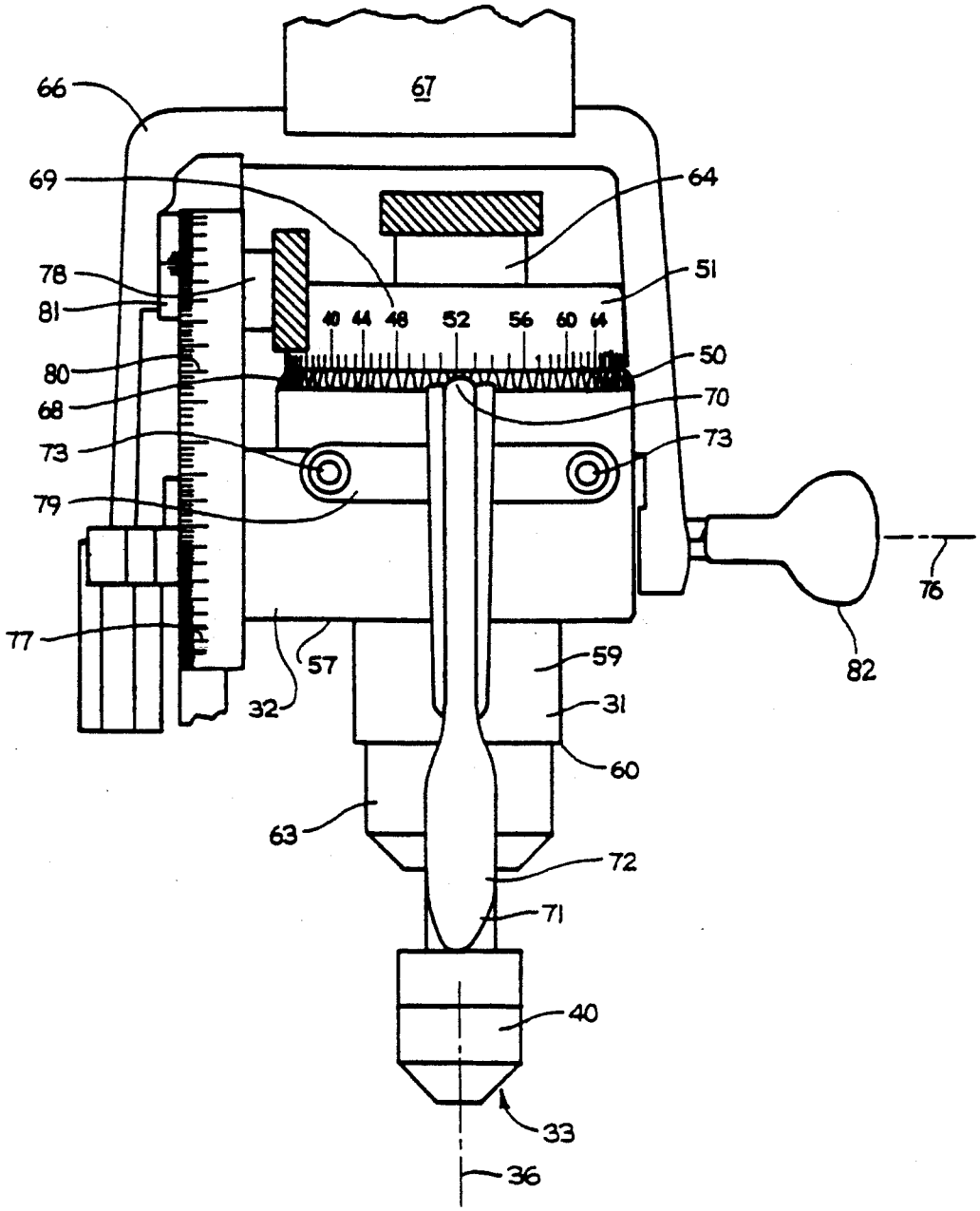
FIG. 3 is a plan view of a dop holder, a sleeve, and a portion of a support arm in accordance with the present invention, taken through a plane indicated as 3—3 in FIG. 1.

Referring next to FIG. 3, an external plan view of the dop holder 31 supported within the sleeve 32, as described above, relates additional external details of such an assembly, and illustrates the support of the assembly by a support arm 66 coupled to a spacer block 67. The spacer block 67 will be more fully discussed hereinbelow. Coordinate structure and elements associated with the support arm 66 are also shown.

As has been previously indicated, the dop holder 31 is journaled within the sleeve 32 so as to be capable of rotating about a longitudinal axis 36 therethrough relative to the sleeve 32. The outer periphery of the retainer 50 is shown to have a plurality of equiangularly spaced apart serrations 68, and the indexing ring 51 is shown to contain an angular index scale 69 embossed or etched appropriately around the circumference of the indexing ring 51. A spring loaded detent means 70 is rigidly coupled to the surface of the sleeve 32 to engage the serrations 68 on the retainer 50, thereby holding the dop holder 31 in a desired angular rotational position within the sleeve 32 as indicated by the angular scale on the indexing ring 51. Pressure imposed downwardly into the plane of FIG. 3 at or proximate to the end 71 of a release lever 72 will pivot the detent means 70 out of engagement with the serrations 68, allowing the dop holder 31 to be rotated about the axis 36 within the sleeve 32 to establish a new rotational orientation of the work. In the embodiment illustrated, the detent means 70 is coupled to the sleeve 32 by screws 73 passing through a mounting bracket 74 into the body of the sleeve 32.

The support arm 66 is formed as a substantially U-shaped member, rigidly coupled to the spacer block 67. Referring briefly to FIG. 1, it should be noted that the legs of the U-shape extend in a substantially horizontal direction from the spacer block 67. Reffering again to FIG. 3, the assembly comprising the dop holder 31 and the sleeve 32 is pivotably coupled to the support arm 66 through a trunnion axis 76 passing through the distal end portions of the legs of the U-shaped support arm 66 such that the first end 33 of the dop holder 31, including the chuck 40, may pivot upwardly and downwardly in a plane perpendicular to the plane of FIG. 3, which perpendicular plane also contains the longitudinal axis 36 of the dop holder 31.

Referring Jointly to FIG. 1 and FIG. 3, the support arm 66 has affixed thereto an arcuate protractor arm 77 extending upwardly and away from the spacer block 67 in a direction parallel to the vertical plane of pivoting of the dop holder 31 about the trunnion axis 76. The arcuate protractor arm 77 describes an arc of a circle centered on the trunnion axis 76. A locking wheel and clamp assembly 78 is rigidly coupled to the side of the sleeve 32 proximate to the arcuate arm 77 by a bracket means (not shown) such that the locking clamp 78 may progress along an arcuate guideway 79 formed in the arcuate arm 77 as the dop holder 31 and sleeve 32 are pivoted about the trunnion axis 76. The angular extent of the arcuate arm 77 and the arcuate guideway 79 is at least sufficient to enable pivoting of the dop holder 31 and the sleeve 32 about the trunnion axis 76 through all angles included between a pivoted orientation whereat the longitudinal axis 36 of the dop holder 31 is substantially horizontal with the first end 33 of the dop holder 31 being most remote from the spacer block 67, and a pivoted orientation whereat the longitudinal axis 36 of the dop holder 31 is substantially vertical with the first end 33 of the dop holder being at its lowest position relative to the trunnion axis 76. When a specified facet angle is to be cut on the work, the locking wheel 78 is manually rotated to loosen the clamp, allowing pivoting about the trunnion axis 76 to the desired facet angle, whereat the locking wheel and clamp 78 are retightened to maintain the so established tilt of the dop holder 31. The arcuate protractor arm 77 is provided with an appropriately calibrated angular scale 80 and the locking wheel and clamp 78 includes an indicator 81 for reading the tilt angle thus set.

The support arm 66 may also include a handle 82 useful in manually elevating and lowering the support arm 66, in a manner to be described below, in order to lift the work from contact with the cutting slab 29 for inspection of the work without the need for distrubing either the tilt angle or rotational orientation established for the facet being cut.

The illustrated embodiment shows that the scale 80 of the arcuate arm 77 and its associated indicator 81 to be disposed around a circumferential surface of the arc of the arcuate arm 77. It is also envisioned that the scale 80 and indicator 81 may be disposed peripherally on a planar surface of a segment of a circle containing the arcuate guideway 79. The present invention is so configured that the entire support arm 66, including those elements it supports, may be inverted in its attachment to the spacer block 67, thus accommodating facile use by both right handed and left handed users.

Referring again to FIG. 1, it is to be noted that as the dop holder 31 is tilted about the trunnion axis 76 to attain differing facet angles, the area of contact of the work held by the dop holder 31 on the cutting slab 29 of the turntable 12 will change. In order to provide freedom of adjustability of the apparatus 10 to enable realignment of the work to an appropriate contact region on the turntable 12, the work supporting mechanism and structure 13 is constructed to be horizontally translatable. A support column 83, comprising a base plate 84, a shaft support collar 86, a shaft 87, and means for enabling and locking the translation, serves as the support for cantilevering the remainder of the work supporting mechanism and structure 13 over the turntable 12. The base plate 84 is configured generally as a rectangular slab having its planar surfaces oriented as substantially horizontal parallel surfaces. A first of said horizontal planar surfaces, identifiable as the upper surface, provides support for the shaft support collar 86, which is rigidly affixed thereon in a substantially centered position of the planar area of the base plate 84. The shaft 87, configured generally as a vertically extending right circular solid cylinder, is rigidly coupled to the shaft support collar 86 to extend upwardly therefrom.

To accomplish the desired adjustment, the support column 83 must be shiftable toward and away from the vertical axis 18 of the turntable 12 in the directions generally indicated by the arrows 88. This motion is enabled by forming a guideway, having a horizontal extent in the directions 88, in an upper surface 89 of the housing 14. The base plate 84 is to have sufficient width to transversely span this guideway. The base plate 84 is provided with a guide 90 depending from the lower surface of the base plate proximate to a first horizontal end thereof, the guide 90 passing slidably through the guideway to engage a clamping plate 91 riding in a clear volume within the housing 14 beneath the guideway. A clamping screw 92 is engaged with the base plate 84, proximate to a horizontal end thereof obverse to the first horizontal end holding the guide 90, so as to depend through the guideway and threadably engage the clamping plate 91. When the clamping screw 92 is sufficiently loose, the clamping plate 91 will not be in contact with the inner surface of the housing 14 obverse to the upper surface 89 thereof, thus enabling the support column 83 to be horizontally translated appropriately in either direction indicated by the arrows 88. When the desired horizontal position of the support column 83 has been reached, the clamping screw 92 is tightened, thereby bringing the clamping plate 91 into frictional contact with said inner surface of the housing 14, precluding further translation of the support column 83 until the clamping screw 92 is again loosened.

The shaft 87 serves as a vertical translational guide for a supporting bracket 93. The supporting bracket 93 is configured generally as a solid rectangular block having a vertical hole formed substantially centrally therethrough to accept passage of the shaft 87. A first vertical side surface 94 of the supporting bracket 93, illustrated in FIG. 1 as a surface included in a vertical plane placed perpendicularly to the plane of FIG. 1 at the illustrated right edge of the supporting bracket 93, includes an integrally formed, upwardly extending portion 96 having a thickness in a horizontal direction parallel with the translational capability of the support column 83, as indicated by the arrows 88. A second vertical surface 97 of the supporting bracket 93, disposed obverse to said first vertical surface 94, includes an integrally formed, depending structure forming a shelf 98 extending substantially horizontally therefrom in a direction progressing from said first vertical surface 94 through said second vertical surface 97. A portion of the rectangular block of the supporting bracket 93 is segregated by a horizontal split plane 99 extending partially through said block. The split plane 99, in conjunction with a vertical split (not illustrated) formed in the second vertical surface 97 of the segregated portion, forms a releasable clamp to hold the supporting bracket 93 in a desired vertical position relative to the extent of the shaft 87. Screw means 100 are provided horizontally through the segregated portion to engage across the vertical split such that tightening of the screw means 100 clamps the segregated portion of the supporting bracket 93 to the shaft 87. This feature may also be noted with added clarity by reference to FIG. 4a.

A pair of vertically spaced apart pivot axes 101, 102 are formed horizontally, in a direction perpendicular to the plane of FIG. 1, through the supporting bracket 93 proximate to, and parallel with, said first vertical surface 94 thereof. The uppermost of said pair, the pivot axis 101, is disposed to pass through the vertically extending portion 96 of the supporting bracket 93, while the other of the pair, pivot axis 102, is disposed to pass through the rectangular block of the supporting bracket 93 proximate to its lowermost extent. A first end of a first upper beam member 103 is pivotably coupled to the supporting bracket 93 at the pivot axis 101. A first end of a second upper beam member 104, disposed so as to be fully hidden in the illustration of FIG. 1, is also pivotably coupled to the supporting bracket 93 at the pivot axis 101, but so horizontally disposed as to be on the obverse side of the shaft 87. A first end of a first lower beam member 106 is pivotably coupled to the supporting bracket 93 at the pivot axis 102. A first end of a second lower beam member 107, disposed so as to be fully hidden in the illustration of FIG. 1, is also pivotably coupled to the supporting bracket 93 at the pivot axis 102, but so horizontally disposed as to be on the obverse side of the supporting bracket 93 and shaft 87.

The first upper beam member 103, the second upper beam member 104, the first lower beam member 106, and the second lower beam member 107 are constrained to be of substantially equal length to their respective second ends, and to extend from their respective pivot axes 101, 102 in mutually parallel directions, generally toward the turntable 12. The second end of the first upper beam member 103 is pivotably coupled to the spacer block 67 at a pivot axis 108 passing horizontally, in a direction perpendicular to the plane of FIG. 1, through the spacer block 67 proximate to its uppermost extent. The second end of the second upper beam member 104 is pivotably coupled to the spacer block 67, on its obverse side, at the pivot axis 108. The second end of the first lower beam member 106 is pivotably coupled to the spacer block 67 at a pivot axis 109 passing horizontally through the spacer block 67 proximate to its lowermost extent, said pivot axis 109 being constrained to be parallel with the pivot axis 108. The second end of the second lower beam member 107 is pivotably coupled to the spacer block 67, on its obverse side, at the pivot axis 109. The pivot axes 108 and 109 are disposed to be vertically aligned and spaced apart by a distance equal to the vertical spacing between pivot axes 101 and 102. As has been previously described, the support arm 66, supporting the sleeve 32, the dop holder 31, and the associated structure so described earlier, is cantilevered from, and coupled to, the spacer block 67.

Since the separations between the pivot points on the first and second ends of each beam member are equal for all beam members 103, 104, 106, and 107, and since the vertical separation between pivot axes 101 and 102 equals the vertical separation between pivot axes 108 and 109, the upper and lower beam members are constrained to pivot about their respective pivot axes 101, 102 such that their mutually parallel arrangement is maintained. The motion of the spacer block 67 during such pivoting is such that the vertical alignment of pivot axes 108 and 109 is also maintained, thereby maintaining the substantially horizontal alignment of the support arm 66. Such a pivoting arrangement can be compared with the commonly known pantograph.

Since a preponderance of the work supporting mechanism and structure 13 is cantilevered from the supporting bracket 93 toward the turntable 12, a significant tipping moment is applied to the support column 83. Moreover, the mass so cantilevered would make it difficult to use the pantographic arrangement of the beam members 103, 104, 106, and 107 to elevate the spacer block 67 and the structure supported thereon from its lowest assumable position. To enable facile elevation of the spacer block 67, the upper beam members 103 and 104 are provided with a counterweight support shaft 110 extending from the pivot axis 101 in a direction generally away from the turntable 12. The counterweight support shaft 110 and the extent of each of the upper beam members 103, 104 are substantially mutually coplanar, with the counterweight support shaft 110 constrained to pivot about the pivot axis 101 as if rigidly coupled to said upper beam members 103, 104. A counterweight 111 slidably engages the counterweight support shaft 110 to be capable of translating along the extent of said shaft 110, thereby changing the balancing moment from a net moment inducing a lowering of the spacer block 67, through a point substantially in balanced equilibrium, to a region wherein a net moment is provided tending to elevate the spacer block 67, said regions arising sequentially as the counterweight 111 is translated toward the distal end of the counterweight support shaft 110. Means 112 are provided to lock the counterweight 111 at a desired position along the extent of the counterweight support shaft 110. The preferred state of net moment is left to the discretion of the user.

Accurate control of facet cutting can be assisted by the inclusion of a feeler guage 113 mounted to the spacer block 67 in a manner such that an indicator lever thereof comes into contact with a stop 114 mounted to the shelf 98 of the supporting bracket 93. As the spacer block 67 depresses due to the cutting away of surface layers of the work, the thickness of material removed from the work can be determined by a dial indicator 116 of the feeler guage 113. Conversely, if the feeler guage 113 is initially set with a reading of the thickness of material to be removed from the work, the cutting operation is completed when the dial indicator 116 of the feeler guage 113 reads zero. The stop 114 also serves as a physically rigid stop to preclude further lowering of the spacer block 67. Means 117 are provided for varying the vertical elevation of the stop 114 relative to the shelf 98 of the supporting bracket 93.

In operation, means 112 are loosened and the counterweight 111 is shifted along the counterweight support shaft 110 toward its distal end until the net tipping moment is such that the spacer block 67 will become elevated to its extreme position, as indicated by the solid line portion of FIG. 1, whereat means 112 may be tightened to retain the counterweight 111 in that position. The chuck 40 of the dop holder 31 is then loosened and a dop bearing a work to be cut is inserted into the dop holder 31. The chuck 40 is then tightened to hold the dop, and the work, in a rigid longitudinal and rotational position relative to the dop holder 31. The desired facet angle to be cut is then set by loosening the locking wheel and clamp 78 and then appropriately pivoting the sleeve 32, holding the dop holder 31 and the work, about the trunnion axis 76 until the angle sought is indicated by the indicator 81 against the scale 80 on the protractor arm 77. The locking wheel and clamp 78 are then tightened to hold the set facet angle. The desired rotational orientation of the work for the facet to be cut is then attained by depressing the release lever 72 (FIG. 3) to disengage the detent 70 (FIG. 3) from the serrations 68 (FIG. 3) on the retainer 50 (FIG. 2) of the dop holder 31, thereby enabling the dop holder 31 to be rotated, within the sleeve 32, about its longitudinal axis to orient the work such that a line through the work perpendicular to the plane of the desired facet is vertical. The release lever 72 is then released to allow the detent 70 to engage the proper serration 68. The counterweight 111 is then repositioned by loosening means 112, translating the counterweight 111 away from the distal end of the shaft 110 until the preferred net moment position is reached, and then retightening means 112 to secure the counterweight 111 in that position. The work is then brought into proximity with the cutting slab 29 by guiding the support arm 66 downwardly using the handle 82. If the region of contact of the work onto the cutting slab 29 is not appropriate, the clamping screw 92 of the support column 83 is loosened and the support column 83 translated horizontally along its guideway to establish a suitable contact region, whereat the clamping screw 92 is retightened. It may also be required to adjust the elevation of the entire work supporting mechanism and structre 13 in order that the work may in fact reach downwardly to the cutting slab 29, or, conversely, so that the work may be raised sufficiently above the cutting slab 29. In such an event, screw means 100 are loosened, enabling the split portion of the supporting bracket 93 to separate along its vertically oriented split line, whence the entire work supporting mechanism and structure 13, including the supporting bracket 93, may be manually raised or lowered to the desired elevation, at which elevation retightening of screw means 100 locks the structure into the selected elevation. The stop 114 and the feeler guage 113 are then appropriately set dependent upon the thickness of material of the work to be removed by cutting. With the work slightly elevated from the cutting slab 29 by the handle 82, the turntable 12 is activated and its speed adjusted by varying the rheostatic control 24. Any desired cutting slurries and the like are then introduced as the work is brought into contact with the cutting slab 29 by downward pressure on the handle 82. Cutting then procedes until the stop 114 is reached and the facet is completed. It is, of course, possible to interrupt cutting a particular facet to inspect the work by merely lifting the handle 82 sufficiently to enable the work to be observed. Subsequent facets, at the same or differing facet angle may be cut by appropriate repetition of the preceding sequence of operations.

Figure 4A:
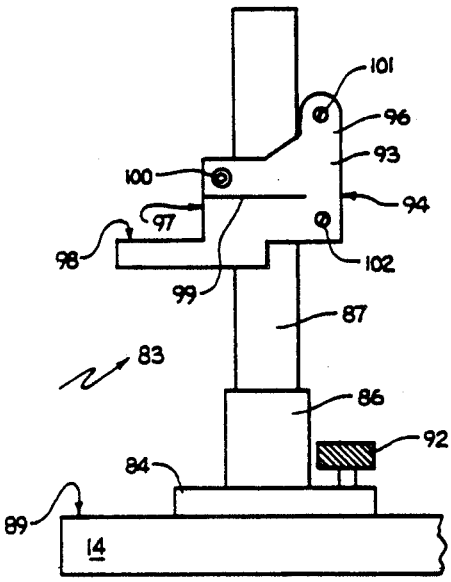
FIG. 4 is a fragmentary elevation view of a support column and supporting bracket that is manually positionable in elevation (FIG. 4*a*) and a threaded support column and supporting bracket (FIG. 4*b*).
Figure 4B:
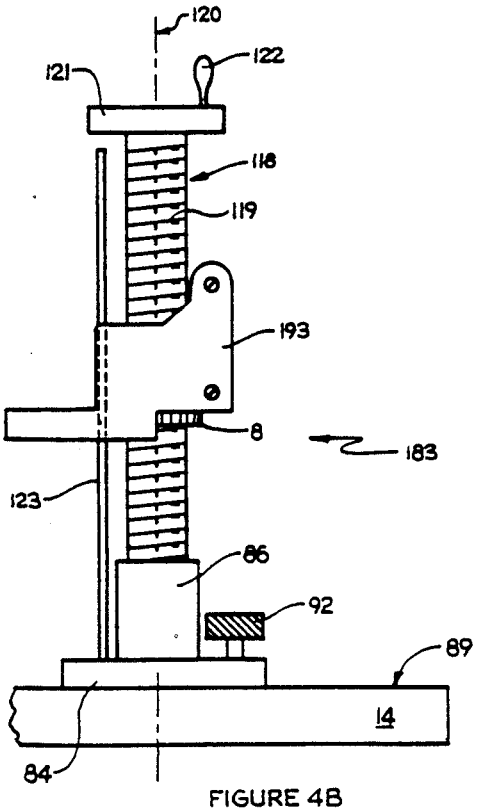

Referring lastly to FIG. 4, FIG. 4*a* presents an isolated view of a support column 83 in accordance with the present invention, more clearly indicating the nature and placement of the split plane 99 and the screw means 100 used for locking the supporting bracket 93 to the shaft 87. FIG. 4*b*, on the other hand, presents an alternate embodiment of a support column 183 wherein the base plate 84, the shaft support collar 86, the guideway in the upper surface 89 of the housing 14, the guide 90,, the clamping plate 91, and the clamping screw 92 illustrated are identical in all respects with the same elements of the preferred embodiment described hereinabove. However, in this alternate embodiment, a support shaft 118 is configured to have threads 119 formed thereon, said shaft 118 being journaled within the shaft support collar 86 to rotate about a vertical longitudinal axis 120, said rotation being produced manually by a crank wheel 121 and handle 122 rigidly coupled to an uppermost distal end of the shaft 118.

The alternate embodiment of FIG. 4*b* also requires an alternate embodiment of a supporting bracket 193 wherein the vertical hole through the supporting bracket 193 is threaded to match the threads 119 of the shaft 118. A second shaft 123 is supported by the base plate 84 to extend vertically upward therefrom through a second vertical hole formed through the supporting bracket 193. The second shaft 123 slidably passes through said second hole to serve as a guide for the supporting bracket 193.

As the handle 122 on the crank wheel 121 is rotated about the axis 120, the shaft 118 is caused to rotate, in a like direction, within the first vertical, threaded hole through the supporting bracket 193. The second, or guide, shaft 123 prevents the supporting bracket 193 from rotating horizontally with the shaft 118. Rather, as the shaft 118 is turned, the supporting bracket 193 will be caused to progress substantially linearly vertically upwardly or downwardly, depending on the pitch of the threads 119 and the direction of rotation of the shaft 118, while sliding upwardly or downwardly accordingly along the guide shaft 123.

This alternate embodiment provides a second variation in the manner in which the elevation of the work supporting mechanism and structure 13 may be adjusted as part of the adjustments necessary to cut facets or the work at differing facet angles.

It is further envisioned that each of the adjustments and motions of the apparatus 10 may be mechanized by appropriate drive and control systems such that partial or full automation of the process of cutting multiple facets may be accomplished.

While the above descriptions define, in detail, a preferred embodiment of the present invention, along with several alternate options as to the nature of particular components thereof, the herein specification of the invention should not be construed as limiting the alternate embodiments that can reasonably flow from consideration of these descriptions. The applicant fully recognizes that those versed in the arts herein employed may find other alternate equivalent structure to accomplish the present invention. Such equivalents are envisioned by the present applicant as being within the intent of the present invention, which shall be limited only by the content and scope of the claims appended hereto.

I claim:

1. A facet cutting apparatus for cutting facets on a work affixed in a desired orientation to an end of a dop, comprising:

a base portion;

a turntable assembly, mounted on said base portion such that a horizontal cutting surface of said turntable assembly is rotatable in a substantially horizontal plane about a substantially vertical axis of rotation through a centroid of said cutting surface;

means for rotating said turntable at a controllably variable angular velocity, said means being disposed substantially within said base portion;

a support column, having a vertical extent, relocatably coupled to said base portion to extend substantially vertically upward therefrom, said support column being translatable relocatable along a guideway formed in said base portion, said guideway and said translatability of said support column extending in a substantially horizontal direction oriented radially relative to the axis of rotation of said cutting surface;

means for releasably locking said support column in a horizontally translated position appropriately selected from among a bonded continuum of such positions along said guideway;

a supporting bracket, coupled to said support column so as to be vertically relocatably positionable along the vertical extend of said support column;

means for releasably locking said supporting bracket to said support column in a selected vertically translated position from among a bounded continuum of such positions along said vertical extent of said support column;

a pantographic mechanism, comprised of a pair of upper beam members, a pair of lower beam members, and a spacer block, pivotably cantilevered, at respective first ends of each of said upper and said lower beam members, from said supporting bracket by a first pair of vertically spaced apart parallel pivot axes passing substantially horizontally through said supporting bracket, said first ends of said pair of upper beam members being pivotably coupled to respectively obverse ends of an upper one of said first pair of pivot axes and said first ends of said lower beam members being pivotably coupled to respectively obverse ends of a lower one of said first pair of pivot axes, said upper and said lower beam members being disposed to extend in mutually parallel directions, through all allowable pivoted positions thereof, from their respective first ends through mutually equal distances to respective distal second ends of each beam member, which second ends are each pivotably coupled to an appropriate end of an appropriate one of a second pair of vertically spaced apart pivot axes passing substantially horizontally through said spacer block, said second pair of pivot axes being parallel with respect to said first pair of pivot axes, said vertical spacing of said second pair of pivot axes being equal to said vertical spacing of said first pair of pivot axes, said cantilevering of said pantographic mechanism extending substantially radially toward said turntable from said supporting bracket such that said vertical alignment of said second pair of pivot axes is maintained throughout all allowable pivoting of said pantographic mechanism about said first pair of pivot axes;

a support arm rigidly coupled to, and substantially horizontally cantilevered from, said spacer black to extend to a distal end thereof in a generally radial direction toward said turntable from said support column;

a sleeve, pivotably coupled to said distal end of said support arm by a trunnion pivot axis extending substantially horizontally transverse to the extend of said support arm, said sleeve having a generally right circular cylindrical hole formed therethrough in a direction perpendicular to said trunnion pivot axis;

means for releasably locking said sleeve relative to said support arm in a desired selectable pivoted orientation of a longitudinal axis of said cylindrical hole, about said trunnion pivot axis, said selectable pivoted orientations all residing in a substantially vertical plane disposed orthogonally with respect to said trunnion pivot axis and including at least all pivoted orientations of said longitudinal axis between a substantially horizontal orientation thereof and a substantially vertical orientation thereof;

a dop holder, configured generally to be supported within said cylindrical hole through said sleeve, in a constant longitudinal position, said dop holder being journaled within said sleeve to be capable of rotating about said longitudinal axis of said hole through any whole or fractional number of revolutions of said dop holder about said axis, said dop holder providing, at a first end thereof, means for axially supporting and retaining a work or a work holding dop, said first end of said dop holder being generally directed to be the end of said dop holder most proximate to said turntable when said longitudinal axis is substantially horizontal and to be the lowest end of the dop holder when said longitudinal axis is substantially vertical;

means for releasably locking said dop holder in a desired rotational orientation about said longitudinal axis;

means for adjustably substantially counterbalancing the mass of all structure and work cantilevered from said supporting bracket;

means for limiting cutting of said work to preclude excessive removal of material therefrom; and means for substantially continuously measuring the thickness of material cut from a work, as measurable from an initial surface of contact of said work on said cutting surface to a current, parallel planar, surface of contact of said work, after removal of material, on said cutting surface;

said facet cutting apparatus being appropriately adjusted in the horizontal translation of said support column relative to said turntable and along said base portion, the vertical translation of the supporting bracket on said support column, the pivoted orientation of the longitudinal axis of said sleeve, and the rotational orientation of said dop holder about said longitudinal axis relative to said sleeve, such that, when said pantographic mechanism is pivoted about said first pair of pivot axes, at said supporting bracket, to substantially its most lowered position, said work will proximately contact the desired cutting region of said cutting surface of said turntable at a desired facet surface forming angle.

2. The facet cutting apparatus of claim 1, further comprising:

means for indicating the angle between a vertical line extending upwardly form the horizontal plane of the cutting surface and the longitudinal axis of said sleeve, thereby defining the angle of a facet surface being cut at said established adjustments; and means for establishing a known first rotational orientation of said dop holder about said longitudinal axis of said sleeve, and for indicating an angular measure of rotational departure of the rotational orientation of said dop holder about said longitudinal axis of said sleeve from said first rotational orientation.

3. The facet cutting apparatus of claim 2, wherein said support column comprises:

a base plate slidably supported on said base portion;

a shaft support collar, rigidly affixed to said base plate to extend vertically upward therefrom; and a shaft, generally configured as a solid right circular cylinder extending longitudinally from a rigid coupling to said shaft support collar, in a generally vertically upward direction, to a distal end thereof, along which shaft said supporting bracket may be slidably vertically translated.

4. The facet cutting apparatus of claim 3, wherein said means for releasably locking said supporting bracket to said support shaft in a selected vertically translated position comprises:

formation of said supporting bracket to include a substantially horizontal planar cut extending partially through said supporting bracket to intersect, but not cut, said shaft of said support column, and to include a substantially vertical planar gap intersecting, but not extending beyond, said horizontal planar cut, an upper horizontal surface of said supporting bracket, said shaft of said support column, and a vertical outer surface of said supporting bracket that is fully intersected by said horizontal planar cut; and screw means, engaged horizontally within said supporting bracket so as to orthogonally span said vertical planar gap, for drawing opposing proximate surfaces of said vertical planar gap of said supporting bracket together to to clamp said supporting bracket to said shaft, and, alternately, for separating said proximate surfaces of said vertical planar gap to enable said supporting bracket to slidably translate vertically along said shaft.

5. The facet cutting apparatus of claim 2, wherein said support column comprises:

a base plate, slidably supported on said base portion;

a shaft support collar, rigidly affixed to said base plate to extend vertically upward therefrom;

a shaft, generally configured as a solid right circular cylinder disposed in a longitudinally vertical orientation, having a screw thread formed to progress longitudinally along the circumferential surface of revolution of said shaft, a first end of said shaft being journaled within said shaft support collar to be rotatable about the vertically oriented longitudinal axis of said shaft;

a crank, coupled to a distal second end of said shaft, obverse to said first end thereof, for rotating said shaft about said vertical axis; and a guide post, rigidly affixed, at a first end thereof, to said base plate at a position proximate to said shaft support collar, said guide post extending vertically upward therefrom;

wherein said supporting bracket is coupled to said shaft of said supporting column by an internal screw thread, in a vertical hole through said supporting bracket, engagably matching the screw thread formed on said shaft, and wherein said guide post extends vertically through a second hole formed vertically through said supporting bracket such that said supporting bracket may slidably translate vertically along said guide post as said supporting bracket is caused to vertically translate by rotation of said shaft engaging said threads.

6. The facet cutting apparatus of claim 5, wherein said means for releasably locking said supporting bracket to said support column in a selected vertically translated position comprises a locking nut engaged with said thread of said shaft, said locking nut being disposed to be beneath the position of said supporting bracket along said shaft, such that, after vertically positioning said supporting bracket by appropriate rotation of said shaft, said lock nut is rotated about said shaft so as to progress upwardly thereon to come into frictional contact with a lowermost horizontal surface of said supporting bracket.

7. The facet cutting apparatus of claim 2, wherein said means for releasably locking said sleeve to said support arm in a desired selectable pivoted orientation of said longitudinal axis of said sleeve comprises:

an arcuate arm, rigidly affixed to said support arm, said arcuate arm being concentric with said trunnion pivot axis, said arcuate arm extending upwardly from said support arm to extend beyond said distal end of said support arm;

an arcuate guideway formed in said arcuate arm concentric with said trunnion pivot axis;

a bracket, rigidly coupled to said sleeve and extending therefrom to an end of said bracket disposed to be non-interferringly proximate to, and arcuately movable along, said arcuate guideway; and means for releasably clamping said bracket to said arcuate guideway.

8. The facet cutting apparatus of claim 7, wherein said means for indicating the angle between a vertical line extending upwardly from the horizontal plane of the cutting surface and the longitudinal axis of the sleeve comprises:

an angularly calibrated scale disposed along a circumferential surface of said arcuate arm; and an index indicator, supported by said bracket coupled to said sleeve, said indicator being so disposed on said bracket as to move through an arc, concentric with said trunnion pivot axis, at a radius circumferentially adjacent said angularly calibrated scale.

9. The facet cutting apparatus of claim 7, wherein said means for indicating the angle between a vertical line extending upwardly from the horizontal cutting surface and the longitudinal axis of said sleeve comprises:

an angularly calibrated scale, disposed along an annular arcuate vertical surface of said arcuate arm: and an index indicator, supported by said bracket coupled to said sleeve, said indicator being so disposed on said bracket as to move through an arc, concentric with said trunnion pivot axis, at a radius enabling non-interferring pivoting of said indicator proximate to said angularly calibrated scale.

10. The facet cutting apparatus of claim 2, wherein said means for releasably locking said dop holder in a desired rotational orientation about said longitudinal axis of said sleeve comprises:

a plurality of equiangularly spaced apart indentations forming a circle around an outer circumferential surface of said dop holder; and a releasable detent, coupled in a fixed position to said sleeve so as to engage with said indentations.

11. The facet cutting apparatus of claim 10, wherein said means for establishing a known first rotational orientation of said dop holder about said longitudinal axis of said sleeve and for indicating an angular measure of rotational departure of the rotational orientation of said dop holder about said longitudinal axis of said sleeve from said first rotational orientation comprises:

an index indicator, rigidly coupled to said detent so as to be proximate to a circumferential surface of said dop holder; and an angularly calibrated scale extending circumferentially around said dop holder proximate to said index indicator, said scale including means for lockably varying the rotational orientation of zero about the circumference of said dop holder.

12. The facet cutting apparatus of claim 2, wherein said means for releasably locking said dop holder in a desired rotational orientation about said longitudinal axis of said sleeve comprises a set screw passing through said sleeve orthoginally to said longitudinal axis, said set screw intercepting and acting against an outer circumferential surface of said dop holder.

13. The facet cutting apparatus of claim 12, wherein said means for establishing a known first rotational orientation of said dop holder about said longitudinal axis of said sleeve and for indicating an angular measure of rotational departure of the rotational orientation of said dop holder about said longitudinal axis of said sleeve from said first rotational orientation comprises:

means for key indexing a dop inserted into and held by said dop holder such that a known orientation of the work is repeatably at a defined zero rotational orientation;

an index indicator, rigidly coupled to said sleeve so as to be proximate to a circumferential surface of said op holder; and an angularly calibrated scale extending circumferentially around said dop holder proximate to said index indicator.

* * * * *